United States Patent [19]

Brusseau et al.

[11] 4,271,892

[45] Jun. 9, 1981

[54] CONVERTIBLE DOOR STRUCTURE

[76] Inventors: H. Donald Brusseau; Louvain M. Brusseau, both of 1803 SE. 45th St., Cape Coral, Fla. 33904

[21] Appl. No.: 7,385

[22] Filed: Jan. 29, 1979

[51] Int. Cl.[3] ..... E06B 3/32

[52] U.S. Cl. ..... 160/92; 160/37

[58] Field of Search ..... 160/37, 89, 90, 91, 160/92, 114; 49/207, 211, 227, 372–378

[56] References Cited

U.S. PATENT DOCUMENTS

| | | | |
|---|---|---|---|
| 806,695 | 12/1905 | Monnin et al. | 160/37 |
| 1,207,885 | 12/1916 | Estabrook | 160/37 |
| 1,382,348 | 6/1921 | Elenga | 49/373 |
| 1,555,308 | 9/1925 | Morgan | 160/92 |
| 1,807,425 | 5/1931 | McCalmon | 160/37 |
| 2,225,050 | 12/1940 | Herzog | 160/92 |

*Primary Examiner*—Peter M. Caun

*Attorney, Agent, or Firm*—Alfred E. Wilson

[57] ABSTRACT

A convertible door structure for hinged mounting in a conventional door frame and including bottom and upper panel portions normally bounded by opposed side stiles and top and bottom cross rails; the lower panel portion is fixed relative to the lower portions of the side stiles and the bottom cross rail. The upper panel portion is hinged along its bottom edge to the top edge of the bottom panel portion in a manner whereby it may be swung from its normal closed position, relative to the top halves of the side stiles and the top cross rail to an open position wherein it overlies the inner face of the bottom panel portion. A pocket or well is defined within the lower panel portion to store a generally conventional type of framed screen unit for selective removal and installation in the opening defined in the upper portion of the door when the upper panel portion is disposed in its down position.

2 Claims, 4 Drawing Figures

CONVERTIBLE DOOR STRUCTURE

BACKGROUND OF THE PRESENT INVENTION

A variety of combination or convertible doors have been provided in the past as evidenced by the following patents: U.S. Pat. Nos. 5,527 and 148,793 to B. J. Williams, U.S. Pat. No. 1,860,648 to P. Bolean, U.S. Pat. No. 295,989 to H. W. Eastman, U.S. Pat. No. 1,983,846 to J. D. Fuller, U.S. Pat. No. 2,225,050 to T. O. H. Herzog, U.S. Pat. No. 2,396,648 to N. L. Gould, U.S. Pat. No. 2,604,156 to N. Lillethorup and U.S. Pat. No. 2,975,830 to W. H. McDonald.

While it is recognized that a variety of panels and windows have been swingably mounted in the past, none of the above listed patents disclose an upper hinged door panel portion which is swingable to a down portion, overlying an inside face of a bottom portion of a door, and including a pocket or well, in the lower portion, to secrete a screen structure for manual removal thereof for installation in an upper opening provided in the door when the upper panel portion is pivotally swung downwardly.

Therefore, one of the principal objects of the present invention is to provide a door having a fixed lower panel portion and a top panel portion hinged along a bottom edge thereof to a top edge of the lower panel portion for swinging movement to a position overlying an inside face of the lower panel portion, and including a screen structure secreted in an interior pocket or well defined in the lower panel portion for installation in the opening defined by the downwardly pivoted top panel portion.

A further object of the invention is to provide means to lock the upper panel portion in its closed position.

Another object of the invention is to provide means to lock the screen in the top opening when the upper panel portion is in its downwardly swung position.

DESCRIPTION OF A PREFERRED EMBODIMENT

Figure 1:
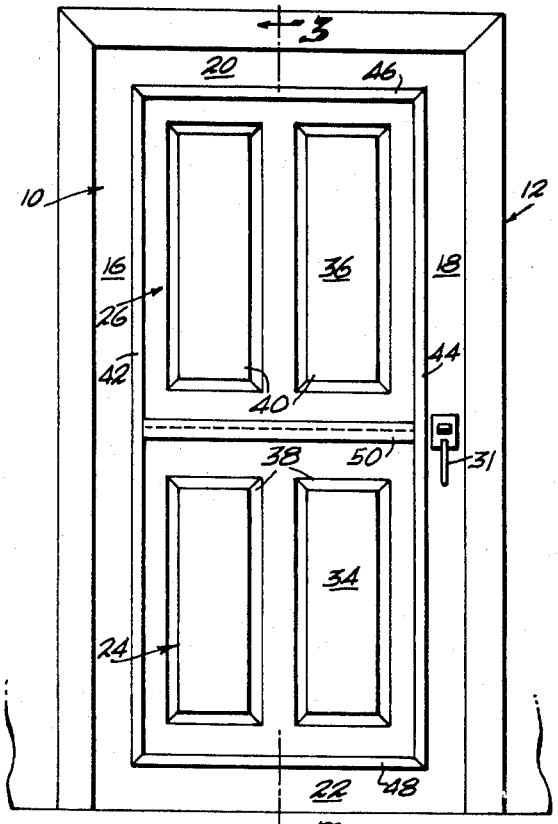
FIG. 1 is an outside elevational view of a door of the present invention with the upper panel thereof in its up position.
Figure 2:
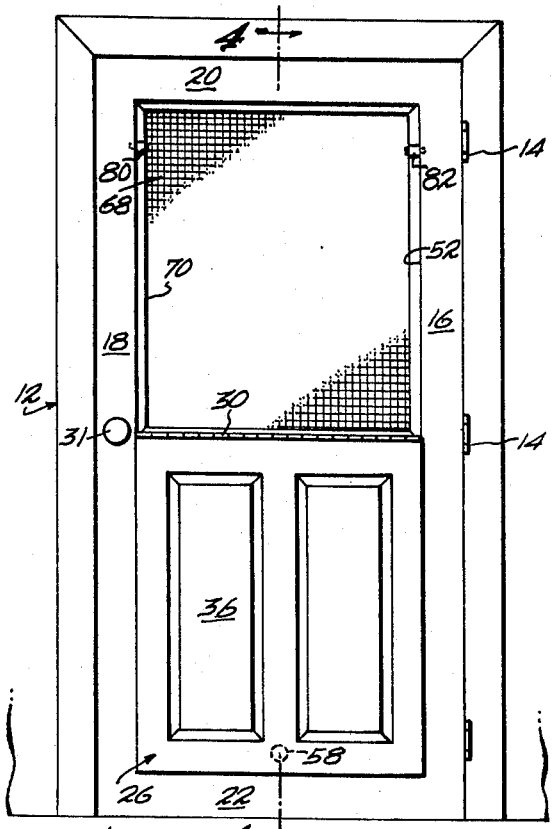
FIG. 2 is an inside elevational view of the door of FIG. 1 with the upper panel pivoted to its down position with a screen structure mounted in the upper space vacated by the top panel portion.

With reference to the drawings, in which like reference characters designate like or corresponding parts throughout the various views, and with particular reference to FIG. 1, the convertible door structure, indicated generally at 10, is erected in a generally conventional frame 12 on a plurality of hinges 14, FIG. 2, in a conventional manner.

Door 10 is constructed of a pair of opposed side stiles 16 and 18, a top cross rail 20, a bottom cross rail 22, a lower panel portion 24 formed in a fixed relation with the lower portion of stiles 16, 18 and bottom cross rail 22, and an upper, separately formed panel portion 26, hinged along its lower edge 28 by a piano hinge 30 to a top edge 32 of lower panel portion 24. Conventional door operator means 31 are provided as seen in FIGS. 1 and 2.

As illustrated in FIG. 1, the outside faces 34, 36 of lower and top panel portions 24, 26 may be provided with decorative designs 38, 40. The door of the present invention is particularly adapted for exterior use. Front exterior doors often are quite decorative and may include one or more small top windows of clear or stained glass and it should be understood that such a window or windows as well as a wide variety of paneled and carved designs may be incorporated in the door of the present invention.

A pair of opposed side trim strips 42, 44 and top and bottom transverse trim strips 46, 48 fixed to the outer face of the door 10, delineate the areas of the fixed lower panel portion 24 and the hinged upper panel portion 26, and an intermediate transverse trim strips 50 separates the two panel portions in FIG. 1.

Figure 3:
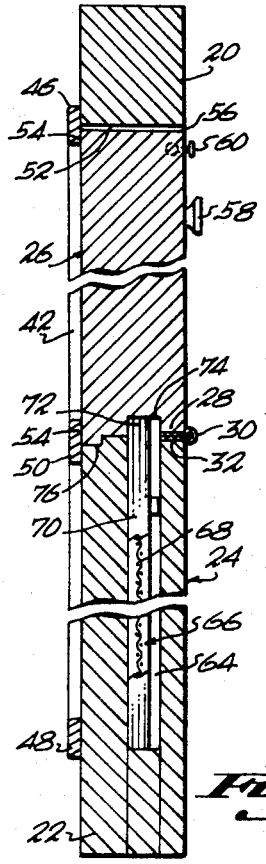
FIG. 3 is a vertical sectional view taken along line 3—3 of FIG. 1.

As best seen in FIG. 3, a suitable opening 52 is formed in the door 10 to receive the upper panel portion 26, and the trim strips, above described, overlap the periphery of opening 52 as at 54 to seat panel portion 26 and to conceal the crack 56 thereabout when said panel is in the closed position of FIGS. 1 and 3.

A pull knob 58 may be fixed in any conventional manner to a top portion of the inside face of upper panel 26 and a latch means, such as a dead bolt 60, may be provided to secure the upper panel 26 in a closed relation with the rest of the door by engaging in one stile such as 16.

A pocket or well 64 is vertically formed in the interior of lower panel 24 to secrete a screen structure 66 therein. The screen structure is in the general form of a conventional window screen, being comprised of a screen cloth 68 in a stretched relation within a peripheral frame 70. The pocket 64 is of such a depth so as to permit an upper edge 72 of the screen 66 to protrude therefrom to provide access thereto for its removal from pocket 64. A groove 74 is formed across the underside of upper panel 26 to accommodate the upper screen edge 72 in the panel closed condition.

Figure 4:
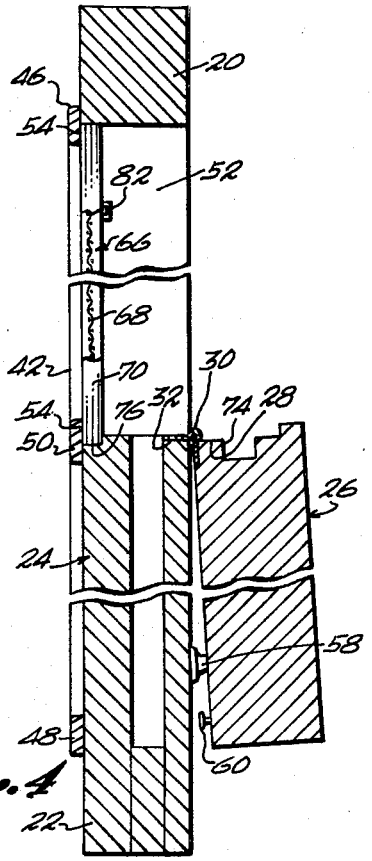
FIG. 4 is a vertical sectional view taken along line 4—4 of FIG. 2.

As illustrated in FIG. 4, the screen structure 66 is inserted into the opening 52 when the upper panel portion 26 is pivoted downwardly to lie against the inside face of lower panel portion 24. The bottom edge of the screen 66 is seated in a groove 76 formed along the top front edge of lower panel 24 and is held in place by the various trim strips 42 through 50 in the same manner as the upper panel portion 26.

Any type of conventional latch means such as 80, 82 are provided to hold the screen in opening 52. The latch means is preferably in the form of simple slide latches or spring loaded latches of the type generally associated with window screens.

It is therefore apparent that a solid panel door may be very quickly converted into a half screen door and as quickly back into a solid panel door without the necessity of going elsewhere to acquire or dispose of the screen structure. Additionally, the screen will remain clean when secured in the pocket 64 and will be ready for instant use as required.

It is also to be noted that the exposed outer face 36 of the upper panel portion 26 is exposed to the interior of the structure when in the open condition and in the case of decorative paneled or carved doors, for example, provide a pleasing addition to the interior decor, when in the open condition of FIGS. 2 and 4.

We claim:

1. A door for hinged mounting to a door frame including side stile members, top end bottom cross rails, a lower fixed panel portion, an upper panel portion hinged along a lower edge thereof to a top edge of said lower panel portion for swinging movement between first and second positions, an opening in an upper portion of the door, above said lower panel portion, sized to receive said upper panel portion in a closing relation thereto in said first position, a top opening vertically extending pocket interiorly of said lower panel portion to receive a screen structure, sized for fitted reception in said opening when said upper panel portion is swung out of said first position to said second position comprising a depending position against an inside face of said lower panel, said pocket being sized to permit a top edge portion of said screen to project upwardly outwardly thereof to a predetermined extent and a bottom edge of said upper panel portion is longitudinally grooved to receive said top edge portion when said upper panel portion is in said first position.

2. The door as defined in claim 1 including means to position said upper panel portion in said opening in said first position, and said screen structure in said opening when said upper panel portion is moved to said second position.

* * * * *